United States Patent [19]

Champlin et al.

[11] 4,130,202

[45] Dec. 19, 1978

[54] CARRIER FOR RECEPTACLES AND BLANK THEREFOR

[75] Inventors: Charles L. Champlin, Rittman; John T. Misura, Wadsworth, both of Ohio

[73] Assignee: Packaging Corporation of America, Evanston, Ill.

[21] Appl. No.: 895,994

[22] Filed: Apr. 13, 1978

[51] Int. Cl.[2] ..... B65D 65/10

[52] U.S. Cl. ..... 206/434; 206/426; 229/40

[58] Field of Search ..... 206/434, 426, 427, 485, 206/45.19, 45.14; 229/40

[56] References Cited

U.S. PATENT DOCUMENTS

| | | | |
|---|---|---|---|
| 3,598,302 | 8/1971 | Nowak | 229/40 |
| 3,931,888 | 1/1976 | Fogel | 206/426 |
| 4,037,721 | 7/1977 | Schillinger | 206/426 |

*Primary Examiner*—William T. Dixson, Jr.
*Attorney, Agent, or Firm*—Neuman, Williams, Anderson & Olson

[57] ABSTRACT

A carrier for receptacles is provided which is formed from a blank of foldable sheet material. The carrier includes a collapsible sleevelike member having foldably connected top, bottom and side panels. Pairs of apertured panel sections are provided which coact with the opposing surfaces of the top and bottom panels to retain a plurality of receptacles within the carrier. Each pair of apertured panel sections are mounted for adjustment between operative and inoperative positions. The inner edges of a pair of panel sections are integral with and foldably connected to one another and, when the panel sections are in an operative position, the inner edges of the sections are spaced a substantial distance from the adjacent opposing surface. The outer edges of the pair of panel sections are foldably connected to opposite peripheral portions of the adjacent opposing surface. A support means is provided for each pair of panel sections and is movable independently of the panel sections and, when in one position of adjustment, supportingly engages the inner edge portions of the panel sections to retain same in an operative position whereby corresponding apertures in the pairs of panel sections accommodate the end portions of a receptacle.

17 Claims, 11 Drawing Figures

CARRIER FOR RECEPTACLES AND BLANK THEREFOR

BACKGROUND OF THE INVENTION

In the packaging of a plurality of receptacles, such as glass tumblers, for retail sales in supermarts or the like, it is important that the resulting package be attractive in appearance and readily stackable on a shelf or counter; the receptacles be readily observable to the prospective customer while retained within the package; the receptacles are segregated from one another while disposed within the package and thus avoid breakage due to accidental contact between the accommodated receptacles; and the package is convenient and comfortable to hand carry when loaded. Furthermore, in packages such as carriers of this general type, it is important that they be readily capable of being expeditiously loaded, and when not loaded be readily collapsible for compact storage.

Various carriers have heretofore been proposed; however, because of inherent design characteristics they were incapable of fulfilling the above noted attributes desired for such a carrier. Also, in many instances such prior carriers were of complex design and formed from blanks requiring an inordinate amount of material, or the setting up and/or gluing of the carrier blank involved the use of special slow-speed equipment.

SUMMARY OF THE INVENTION

Thus, it is an object of the invention to provide a carrier of the type described which is not beset with any of the aforenoted shortcomings associated with the prior structures.

It is a further object of the invention to provide a carrier of the type described which is capable of accommodating a variety of receptacles.

It is a still further object of the invention to provide a carrier of the type described which is capable of being collapsed for compact storage.

It is a still further object of the invention to provide a carrier of the type described which enables the accommodated receptacles to be readily observed without having to be removed from the carrier.

It is a still further object of the invention to provide a blank for a carrier of the type described which may be readily formed by conventional high-speed slotting, scoring and slitting equipment and also may be readily glued utilizing conventional high-speed gluing equipment.

Further and additional objects will appear from the description, accompanying drawings, and appended claims.

In accordance with one embodiment of the invention, a carrier for a plurality of receptacles is provided which is formed from a single blank of foldable sheet material. The carrier includes a top panel, a bottom panel and interconnecting side panels which coact with one another to form a collapsible sleevelike member. Disposed at and connected to the opposing surfaces of the top and bottom panels are receptacle-retaining means. Each retaining means is of substantially like construction and includes a pair of apertured panel sections having the corresponding inner edges thereof integral with and foldably connected to one another. The outer edge of each panel section is foldably connected to a peripheral edge portion of the adjacent opposing surface. One of the panel sections of each pair is provided with a foldline disposed in spaced, substantially parallel, adjacent relation with respect to the outer edge of the panel section. The foldline extends across the full width of the panel section. The panel sections of each pair are adapted to be moved relative to the adjacent opposing surface between an operative and an inoperative position. When each pair of panel sections is in an operative position, the foldably connected inner edges of the panel sections are disposed in a substantially spaced relation with respect to the adjacent opposing surface whereby the panel sections extend convergently from opposite edge portions of the adjacent opposing surface. Corresponding apertures in the pairs of panel sections are disposed in vertically spaced, aligned relation when the pairs are in operative positions so as to accommodate the end portions of the receptacles. Each pair of panel sections is provided with a support which is mounted for movement independently of the pair of panel sections and, when in one position of adjustment, supportingly engages the inner edges of the panel sections and retains the latter in an operative position.

DESCRIPTION

For a more complete understanding of the invention reference should be made to the drawings wherein.

Figure 1:
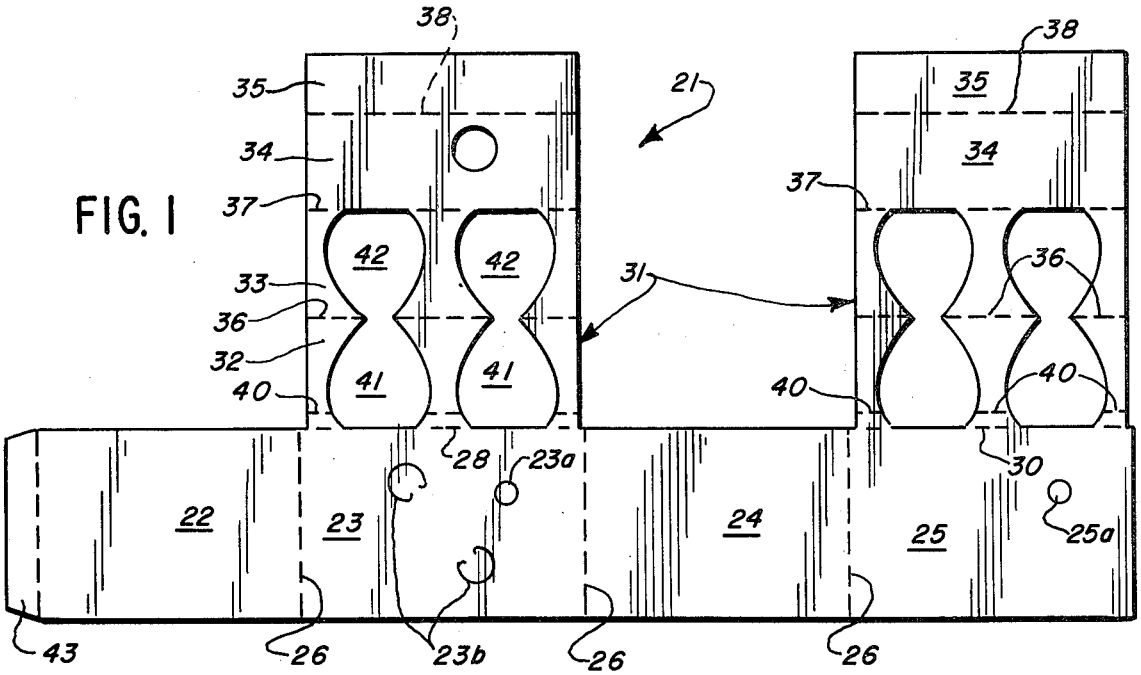
FIG. 1 is a top plan view of one form of an improved carrier blank.
Figure 6:
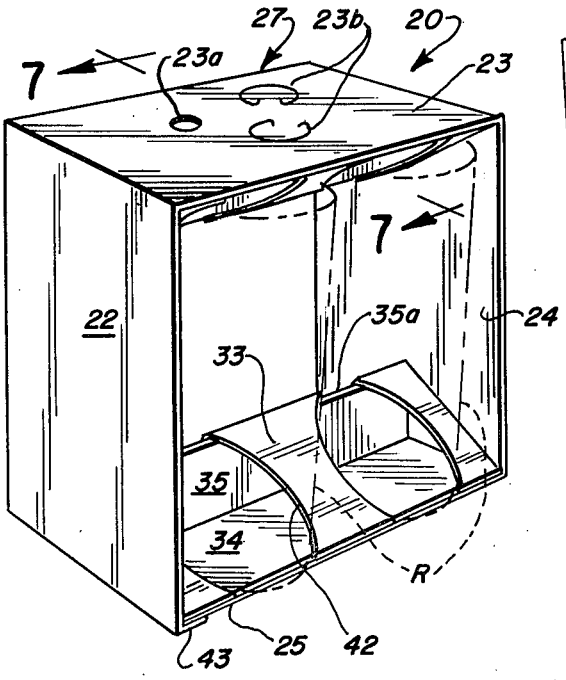
FIG. 6 is a side perspective view of the improved carrier set up from the blank of FIG. 1 and with a plurality of receptacles, shown in phantom lines, accommodated therein.

Referring now to the drawings and more particularly to FIG. 6 one form of the improved carrier 20 is shown for use in accommodating a plurality of receptacles R, shown in phantom lines. The receptacles in the illustrated embodiment are glass tumblers. Carrier 20 is formed from a single blank 21 of foldable sheet material (e.g., paperboard), see FIG. 1. The configuration of blank 21, to be hereinafter described, is such that conventional high-speed slotting, scoring and slitting equipment may be utilized to form the blank for the carrier 20.

Blank 21 includes a first side panel 22, a top panel 23, a second side panel 24, and a bottom panel 25, which are arranged in successive side-by-side relation and adjacent panels are connected by an elongated foldline 26. The foldlines 26 are disposed in spaced parallel relation. When the blank 21 is fully set up, as seen in FIG. 6. panels 22–25 coact to form a collapsible sleevelike member 27 in which the receptacles R are located when the carrier is loaded.

Connected by foldline 28, 30 to the corresponding one side of top panel 23 and bottom panel 25, respectively, is an extension 31, each of which is of substantially like construction. Each extension includes a pair of apertured panel sections 32, 33; a reinforcing panel 34; and a supporting flap 35. Each panel section 32 has an outer edge thereof connected by foldline 28, 30 to the respective top and bottom panels 23, 25. The opposite or inner edge of panel section 32 is connected by a foldline 36 to the corresponding inner edge of panel section 33. The outer edge of panel section 33 is connected to reinforcing panel 34 by a foldline 37. Panel 34, in turn, is connected to flap 35 by a foldline 38. It is to be noted that each panel section 32 is provided with a foldline 40 which is disposed adjacent to and in spaced parallel relation with respect to foldline 28, 30. Foldline 40, even though partially interrupted by apertures or openings 41, extends across the full width of panel section 32. All of the foldlines of each extension 31 are disposed in spaced parallel relation.

Each panel section 32, 33 of an extension 31 is provided with a pair of apertures 41, 42 which are shaped so as to snugly accommodate an end portion of a receptacle R, when the carrier is loaded. In blank 21, portions of the perimeters of corresponding apertures 41, 42 of panel sections 32, 33 may intersect one another at foldline 36, as well as foldlines 28, 30, 37 and 40; however, such intersection by one or more of these apertures is not a critical feature insofar as the blank configuration is concerned.

Figure 2:
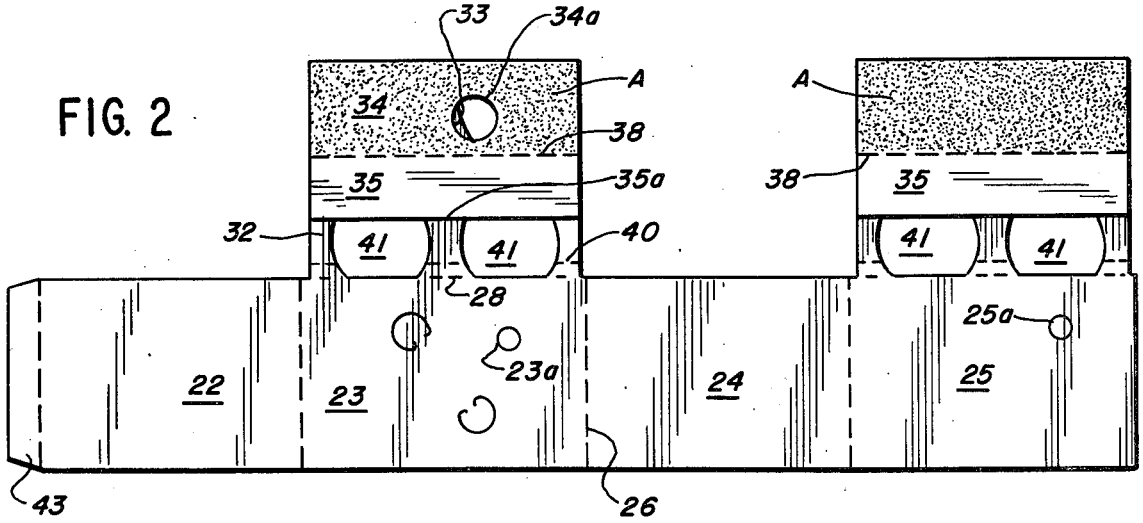
FIGS. 2–5 are top plan views of successive steps in folding the blank of FIG. 1 into one form of the improved carrier in a collapsed state suitable for compact storage.
Figure 3:
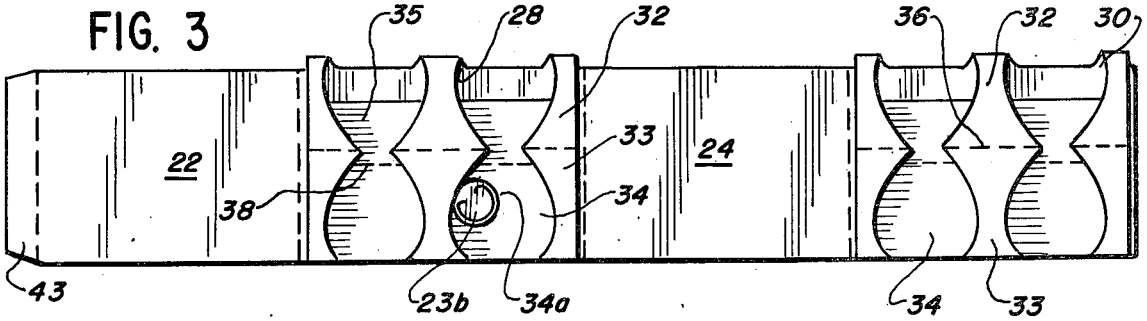
Figure 4:
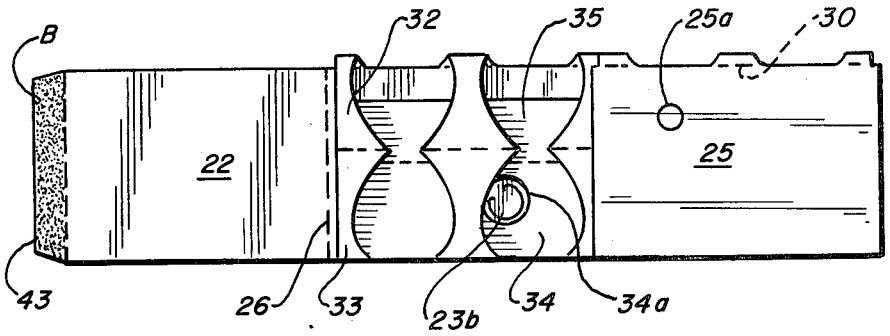

In setting up blank 21 to form the carrier 20, the folding sequence in part is as follows: (a) panels 34, 35 are folded as a unit about foldline 37 so as to overlie panel sections 32, 33, see FIG. 2; if desired, however, panel 35 may be folded about foldline 38 into overlying relation with respect to panel 34 before the panels are folded as a unit about foldline 37; in the latter arrangement panel 35 would then be sandwiched between panels 34 and 33; (b) the partially folded blank is then passed beneath a conventional glue roller, not shown, whereby a coating of suitable adhesive A is applied to the exposed surfaces of panels 34; and (d) the partially folded extensions 31 are then folded as a unit about foldlines 40 so as to overlie the corresponding top and bottom panels 23, 25, see FIG. 3. Because of the adhesive coatings A, panels 34 readily adhere to the surfaces of panels 23, 25 engaged thereby. The engaged surfaces of panels 23, 25 subsequently become opposing surfaces when the carrier is fully set up, see FIG. 6. Subsequent to panels 34 being adhesively affixed to the respective panels 23, 25, panel 25 is then folded about foldline 26 so as to overlie the second side panel 24, see FIG. 4. While the blank 21 is in the partially folded state, as seen in FIG. 4, a coating of adhesive B is applied to the exposed surface of a glue flap 43, which is foldably connected to the edge of the first side panel 22. Subsequent to the application of the adhesive coating B, first side panel 22 and the glue flap 43 are folded as a unit about foldline 26, so that the panel 22 will overlie the panel sections 32, 33 associated with the top panel 23 and the glue flap 43 will be adhesively secured to the exposed surface of the bottom panel 25, see FIG. 5. The folded blank, as seen in FIG. 5, is in a collapsed state and while in such a state is suitable for compact storage until it is to be loaded.

Figure 5:
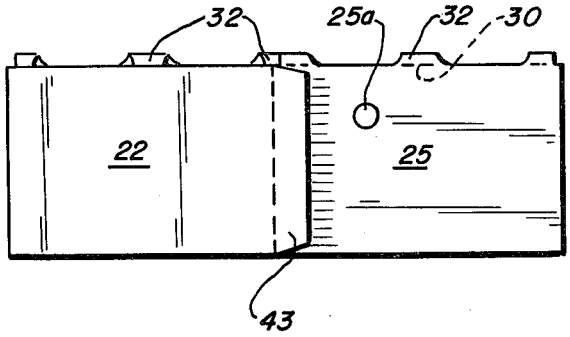

When the folded blank of FIG. 5 is to be set up for loading, the top, bottom and side panels 23, 25, 22 and 24, respectively, are squared up so as to form the sleeve-like member 27. The supporting flap 35, which in each instance is lying flat against the adjacent surface of the top or bottom panel and is sandwiched between the pair of panel sections 32, 33 and the adjacent surface of said top or bottom panel, is pivoted about foldline 38 so as to assume a perpendicular position relative to the respective panel 23, 25. Upon flap 35 being pivoted in the manner as described, the flap will slidably engage one panel of the adjacent pair of panel sections 32, 33 and cause the foldably connected panel sections to move relative to one another so as to assume an operative position, see FIGS. 6–7. When the panel sections of a pair are in an operative position, the sections 32, 33 converge towards one another from their outer edges so that the foldline 36 is spaced the greatest distance from the adjacent panel 23 or 25. The free edge 35*a* of the flap 35 is substantially centrally located and is aligned with and supportingly engages the foldline 36 thereby retaining the panel sections in an operative position. In addition to supporting the panel sections in an operative position, flap 35 serves as a partition between the corresponding apertures 41, 42 of the panel sections and thus prevents the accommodated end portions of the receptacles R disposed within the aperturs from accidentally striking one another while the carrier is being loaded and while the loaded carrier is being subjected to normal handling by the customer or during bulk handling while in transit to a retail outlet.

Figure 7:
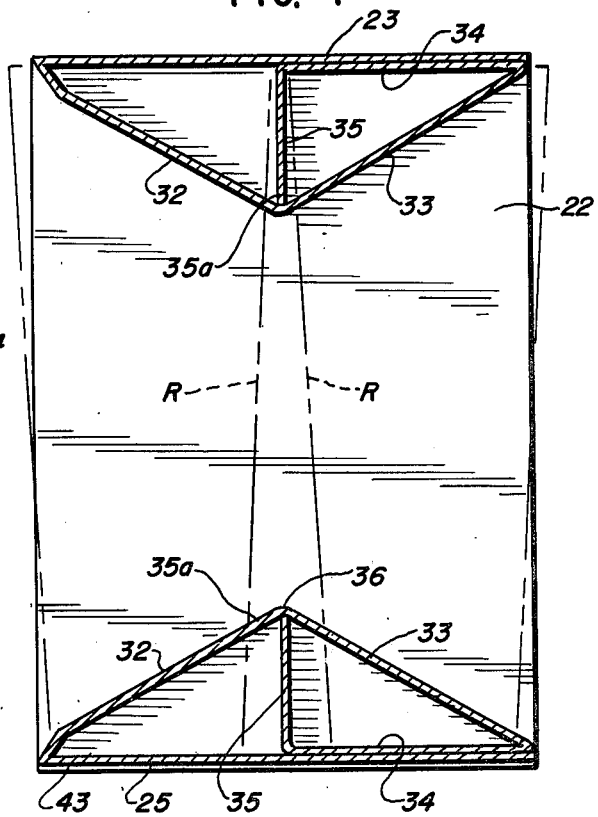
FIG. 7 is an enlarged sectional view taken along line 7—7 of FIG. 6.

To facilitate moving of the flap 35 to its perpendicular position, see FIG. 7, an opening 23*a*, 25*a* may be provided in panels 23, 25, respectively, through which a finger or probe, not shown, may be inserted for pushing the flap into place.

Foldline 40, provided in each panel section 32, enables each pair of panel sections 32, 33 to readily assume a collapsed, inoperative position when the flap 35 is lying flat against either panel 23 or 25. When the panel sections 32, 33 of a pair are in an inoperative position, they are disposed in a substantially coplanar relation.

In addition to opening 23*a*, the top panel 23 may be provided with a pair of diagonally disposed finger holes 23*b*. The diagonal disposition of the holes 23*b* permits the fingers inserted therethrough to extend into the open ends of two of the accommodated receptacles. An opening 34*a*, formed in reinforcing panel 34, is aligned with one of the finger holes 23*b* when the panel is adhesively secured to top panel 23, as seen more clearly in FIG. 3, so that the panel 34 will not obstruct insertion of the finger through the finger hole 23*b*.

Figure 8:
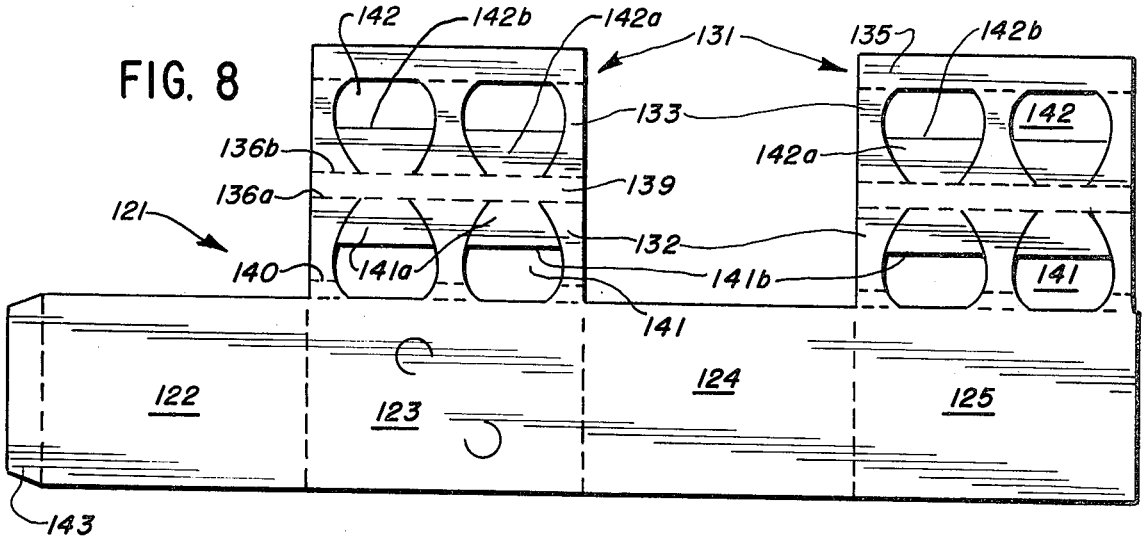
FIG. 8 is similar to FIG. 1 but showing a second form of an improved carrier blank.
Figure 9:
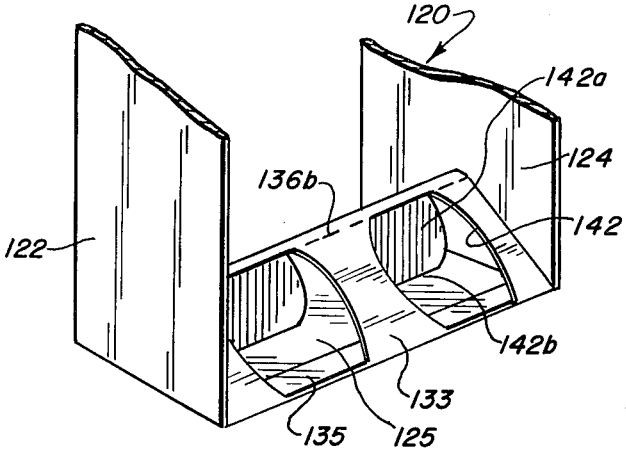
FIG. 9 is a fragmentary perspective view of an improved carrier set up from the blank of FIG. 8 and showing only the lower pair of panel sections disposed in an operative position.

A second form of blank 121 is shown in FIG. 8 which has many structural similarities to that of blank 21; accordingly, like portions of blank 121 will be identified by the same numeral except in the one hundred series. The principal structural difference embodied in blank 121 relates to the configuration of the extensions 131. Panel sections 132, 133 have the inner edges thereof foldably interconnected by means of a narrow strip 139 which extends across the full width of the extension. The strip 139 is delimited on two sides by a pair of elongated foldlines 136*a*, 136*b* which are arranged in spaced parallel relation. Foldably connected to strip 139 by relatively spaced segments of foldline 136*a* are tabs 141*a* which are struck out from corresponding parts of the apertures 141 formed in panel section 132. In a similar fashion, tabs 142*a* are struck out from corresponding parts of the apertures 142 formed in panel section 133. The length of each tab 141*a*, 142*a*, measured perpendicularly from the respective foldline 136*a*, 136*b*, is the same, so that when the pair of panel sections 132, 133 is adjusted to an operative position, as seen in FIG. 9, the free edges 141*b*, 142*b* of the tabs will engage the adjacent surface of the top or bottom panel 123, 125 and the tabs will assume substantially perpendicular positions relative to such panels 123, 125. A narrow glue panel 134 is foldably connected to each panel section 133 and replaces panels 34, 35 of blank 21. Glue panel 134 is adhesively affixed to the inwardly facing surface of the respective top or bottom panel 123, 125. The carrier 120 formed from blank 131 is adapted to accommodate a plurality of receptacles in the same manner as carrier 20, see FIG. 6.

To adjust panel sections 132, 133 from an inoperative position to an operative position, requires that first the top, bottom and side panels 123, 125, 122, 124, respectively, be squared up to form a sleevelike member. Subsequently, the tabs of one pair of panel sections are manually folded so as to assume upright positions while at the same time the narrow strip 139 is pulled away from the adjacent surface of panel 123, 125. Once the selected pair of panel sections has been moved to the operative position, the same sequence of steps is repeated with respect to the remaining pair of panel sections.

Figure 11:
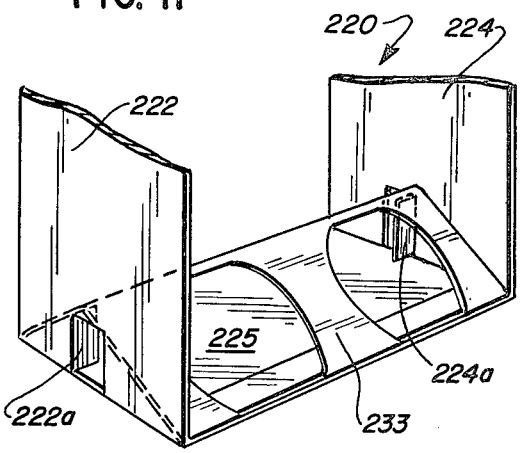
FIG. 11 is similar to FIG. 9 but showing an improved carrier set up from the blank of FIG. 10.
Figure 10:
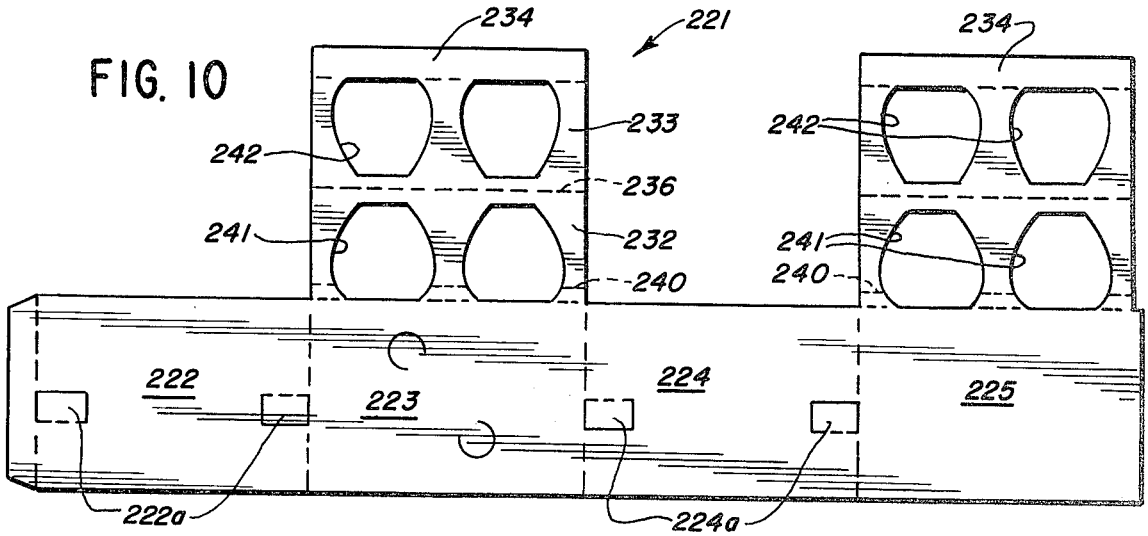
FIG. 10 is similar to FIG. 1 but showing a third form of an improved carrier blank.

A third form of improved carrier 220 and blank 221 therefor is shown in FIGS. 11 and 10, respectively. Portions of blank 221 which are similar to those of blank 21 are identified by the same numeral except in a two hundred series. The extensions 231 of blank 221 are of like configuration and each extension includes a pair of panel sections 232, 233 which have the inner edges thereof connected to one another by an elongated foldline 236. The foldline 236 extends across the full width of the extension and is not intersected by any perimetric segments of the apertures 241, 242 formed in the panel sections. Panel sections 233 are connected to the adjacent surfaces of panels 223, 225 by narrow glue panels 234 in the same way as described with respect to blank 121. Each pair of panel sections 232, 233 is retained in an operative position, see FIG. 11, by a pair of tabs 222*a*, 224*a* which are struck out from the respective side panels 222, 224. To move a pair of panel sections 232, 233 to an operative position requires that with one hand of the operator the portion interconnecting the pair of panel sections is pulled away from the adjacent surface of the top or bottom panel 223, 225 and then, while the panel sections are held in such a relative position, the other hand of the operator causes the corresponding side wall tabs 222*a*, 224*a* to be pushed inwardly towards one another so that the upper or lower edges of the tabs, depending upon whether the top or bottom panel 223, 225 is involved, supportingly engage the pair of panel sections at the foldline 236, see FIG. 11. Because of the convergent disposition of the inner edge portion of the panel sections, the inwardly extending tabs will be retained in their inwardly folded positions. As in the case of the other carriers 20, 120, the receptacles are loaded into the carrier 220 and retained therein in same manner as previously described.

A common structural feature embodied in all forms of the improved carrier blank is that the extensions extend laterally from one side of the blank and, thus, greatly facilitate and simplify the folding and gluing operations. Furthermore, the blank configurations enable the blanks to be arranged in inverted relation on a web or sheet material so that a minimum of material waste occurs. The size and shape of the various panels and tabs embodied in the blanks may vary from that shown and will depend upon the number and shape of the receptacles to be accommodated within the carrier.

We claim:

1. A carrier of foldable sheet material for accommodating a plurality of receptacles, said carrier comprising a sleevelike member including a top panel, a bottom panel, and a pair of side panels foldably connecting corresponding first peripheral portions of said top and bottom panels; and receptacle-retaining means provided on opposing surfaces of said top and bottom panels, the retaining means for each opposing surface including a pair of apertured panel sections overlying said opposing surface and adjustable relative thereto between an operative position and an inoperative position, said apertured panel sections having corresponding inner edges integral with and foldably connected to one another and the corresponding outer edges foldably connected to opposite second peripheral portions of said top and bottom panels, one panel section of a pair being provided with a foldline spaced from and substantially parallel to the foldable connection of the outer edge of said one panel section, the inner edges of said pair of panel sections being spaced the greatest distance from the opposing surface when said pair of apertured panel sections is in an operative position, and support means movable independently of said pair of panel sections and supportingly engaging the foldably connected inner edges thereof to effect retention of said pair of panel sections in said operative position.

2. The carrier of claim 1 wherein the support means includes an elongated flap having one elongated edge thereof foldably connected to the adjacent opposing surface and an elongated second edge independent of said pair of apertured panel sections and adapted to supportingly engage the foldably connected inner edges of said pair of panel sections only when the latter are in said operative position.

3. The carrier of claim 2 wherein an aperture of one panel section of a pair is separated from an aperture of the other panel section of the pair by a plane including said elongated flap when the latter is in supporting engagement with said pair of panel sections.

4. The carrier of claim 1 wherein corresponding apertures formed in said pairs of apertured panel sections are in substantial vertical alignment when both pairs of panel sections are in operative positions.

5. The carrier of claim 2 wherein each elongated flap is disposed in substantially parallel relation with at least one apertured panel section of a pair and is sandwiched between said apertured panel and the adjacent opposing surface when the pair of panel sections is in said inoperative position.

6. The carrier of claim 2 wherein the elongated flaps of said pairs of apertured panel sections are disposed in substantially coplanar relation when both of said pairs of panel sections are in operative positions.

7. The carrier of claim 1 wherein the support means includes flaps struck out from apertures formed in the pairs of panel sections, each flap having a peripheral segment thereof foldably connected to a perimetric segment of the aperture disposed adjacent the inner edge of said panel section, said flap being angularly disposed relative to said panel section when the latter is in an operative position and being substantially coplanar with said panel section when the latter is in an inoperative position.

8. The carrier of claim 7 wherein each aperture of an apertured panel section is provided with a struckout flap.

9. The carrier of claim 2 wherein each opposing surface includes a reinforcing panel having a first peripheral segment thereof foldably connected to the one elongated edge of the support means flap and a second peripheral segment thereof foldably connected to the outer edge of one of the adjacent pair of panel sections.

10. The carrier of claim 1 wherein the support means for each pair of apertured panel sections includes a pair of flaps struck out from the adjacent side panels of said sleevelike member, each flap supportingly engaging the foldably connected inner edges of an adjacent pair of panel sections when the latter are in operative position, said flaps being substantially coplanar with the respective side panels when the apertured panel sections are in inoperative position.

11. A blank of foldable sheet material for forming a carrier used to carry a plurality of receptacles, said blank comprising a plurality of panels arranged in side-by-side relation with adjacent panels being foldably connected to one another; a pair of extensions disposed adjacent one side of said blank and being foldably connected to and extending laterally from a pair of alternately disposed panels; each extension including a pair of apertured panel sections having outer and inner edges, the latter edges being foldably connected to one another, the outer edge of one panel section being foldably connected to an edge of an adjacent one of said pair of alternate panels, said one panel section being provided with a foldline adjacent to but in spaced parallel relation to the outer edge of said one panel section, the outer edge of the second panel section of said pair of panel sections being provided with means for foldably connecting the outer edge thereof to said adjacent alternate panel at a substantial distance from the outer edge of the said one panel section when said blank is set up to form a carrier; and foldable support means for supportingly engaging the foldably connected inner edges of each pair of panel sections whereby the foldably connected inner edges are retained in spaced overlying relation with respect to the alternate panel to which said panel sections are connected when said blank is set up to form a carrier to accommodate the receptacles.

12. The blank of claim 11 wherein the extensions are of like configuration.

13. The blank of claim 12 wherein each extension is provided with foldable support means.

14. The blank of claim 13 wherein the foldable support means includes an elongated flap foldably connected to the outer edge of said second panel section of the pair of panel sections.

15. The blank of claim 14 wherein the elongated flap includes a reinforcing segment and a support segment foldably connected thereto; when the blank is set up to form the carrier for the receptacles, said reinforcing segment being affixed in overlying relation to the adjacent alternate panel, and said support segment being movable independently of said reinforcing segment into a position substantially perpendicular to the adjacent alternate panel whereby a free peripheral edge of the support segment is in supporting engagement with the foldably connected inner edges of said pair of panel sections.

16. The blank of claim 13 wherein the foldable support means includes a plurality of foldable flaps struck out from predetermined apertures formed in the pair of panel sections.

17. The blank of claim 12 wherein the foldable support means includes a plurality of foldable tabs struck out from an adjacent panel foldably connected to an alternate panel from which an extension extends; each tab being disposed adjacent the foldable connection between the panels and each tab being foldable about an axis substantially perpendicular to the foldable connection between said panels.

* * * * *